US006551070B2

(12) United States Patent
Burns et al.

(10) Patent No.: US 6,551,070 B2
(45) Date of Patent: Apr. 22, 2003

(54) DEVICES AND METHODS FOR NOISE SUPPRESSION IN PUMPS

(75) Inventors: Stephen Michael Burns, Portland, OR (US); Charles F. Carr, Vancouver, WA (US)

(73) Assignee: Micropump, Inc., a unit of IDEX Corporation, Vancouver, WA (US)

( * ) Notice: Subject to any disclaimer, the term of this patent is extended or adjusted under 35 U.S.C. 154(b) by 9 days.

(21) Appl. No.: 09/935,532

(22) Filed: Aug. 22, 2001

(65) Prior Publication Data

US 2003/0039551 A1 Feb. 27, 2003

(51) Int. Cl.[7] ..... F04B 19/24
(52) U.S. Cl. ..... 417/53; 417/410.4
(58) Field of Search ..... 417/53, 356, 410.4, 417/363, 420; 418/21, 171, 1, 83; 123/196 S

(56) References Cited

U.S. PATENT DOCUMENTS 3,746,481 A * 7/1973 Schippers ..... 418/83
4,526,518 A * 7/1985 Wernicki ..... 417/420
4,583,924 A * 4/1986 Zenglein et al. ..... 417/420
4,662,827 A * 5/1987 Wernicki ..... 417/363
5,219,276 A * 6/1993 Metzner et al. ..... 417/356
5,423,661 A * 6/1995 Gabeler et al. ..... 417/410.4
5,571,003 A * 11/1996 Tuckey ..... 418/1
5,765,521 A * 6/1998 Stutzle et al. ..... 123/196 S
6,106,256 A * 8/2000 Talaski ..... 418/171
6,158,983 A * 12/2000 Harpole et al. ..... 417/410.4
H1966 H * 6/2001 Henry, IV et al. ..... 417/356
6,244,839 B1 * 6/2001 Cole et al. ..... 418/21
6,247,906 B1 * 6/2001 Pijanowski ..... 417/410.4

* cited by examiner

*Primary Examiner*—Teresa Walberg
*Assistant Examiner*—Leonid Fastovsky
(74) *Attorney, Agent, or Firm*—Klarquist Sparkman, LLP

(57) ABSTRACT

Gear pumps are disclosed having a gear-assembly section, a drive-assembly section, and at least one passage fluidly connecting the gear-assembly and drive-assembly sections, wherein the passage includes substantially non-movable walls defining a non-linear fluid-flow path. A particular example is a magnetic gear pump having a gear-assembly section; a section that includes a magnet assembly received in a cup cavity; and a third section located between the gear-assembly and magnet-assembly sections, wherein the third section includes a fluid-input port, a fluid-output port, and at least one conduit for fluidly interconnecting the gear-assembly and magnet-assembly sections; and a member defining at least one non-linear passage in fluid connection with the third section conduit and the cup cavity.

45 Claims, 3 Drawing Sheets

DEVICES AND METHODS FOR NOISE SUPPRESSION IN PUMPS

FIELD OF THE DISCLOSURE

The present devices and methods relate to pumps, particularly gear pumps.

BACKGROUND

Gear pumps as known in the art are particularly advantageous for pumping fluids while keeping the fluids isolated from the external environment. This benefit has been further enhanced by the advent of magnetically coupled drive mechanisms that have eliminated leak-prone hydraulic seals around drive shafts. Gear pumps have been adapted for use in many applications including applications requiring extremely accurate delivery of a liquid to a point of use. Such applications include, for example, delivery of liquids in medical instrumentation and delivery of liquid ink to continuous ink-jet printer heads.

Gear pumps usually include a gear-assembly section and a drive-assembly section. The fluid flowing through the pump passes through the gear-assembly section.

Often there is also a need to provide fluid in the drive-assembly section. For example, the drive assembly may include moving parts that are in contact thereby generating heat and wear. Passing fluid between these moving parts acts as a lubricant that reduces such heat and wear.

In magnetic gear pumps in particular, typically a partition hydraulically isolates a gear-assembly section from a magnet-coupling section. However, the partition includes a flow passage for permitting fluid to flow from the gear-assembly section to the magnet-coupling section. In current commercial designs this flow passage defines a linear fluid-flow path. A magnetic gear pump also includes an outer annular magnet turned or rotated by a motor (i.e., the "driving" magnet). An annular inner magnet is disposed within the outer magnet and is carried on a drive shaft (i.e., the "driven" magnet). The inner magnet is isolated from the outer magnet by a thin metallic or plastic cup (referred to herein as a "magnet cup").

Cavitation noise in pumps is a general problem, especially when operating in conditions with an inlet pressure at or near the vapor pressure of the fluid. Cavitation is the sudden formation and subsequent collapse or implosion of low-pressure bubbles in a fluid as the fluid flows from an area of higher pressure to an area of lower pressure (area of bubble formation) and then returns to an area of higher pressure (area of bubble collapse). As the bubbles collapse, energy is released that causes structural vibrations within the pump. Such structural vibrations generally result in the production of noise. In certain applications gear pumps operate at very low fluid inlet pressures. In such instances, the low-pressure portion of the pump is upstream from the gears and the high-pressure portion of the pump is downstream from the gears. Cavitation bubbles are formed in such gear pumps, for example, as the fluid moves from low-pressure areas to high-pressure areas, such as at the fluid inlet, and as the fluid travels through the chamber occupied by the gears. In addition, bubbles are present in the fluid as it enters into the pump. The collapse of such pre-existing bubbles also contributes to noise production. There is a continuing need for successful solutions for reducing noise emanating from pumps.

SUMMARY OF THE DISCLOSURE

In order to address the noise-generation problem, the present inventors constructed a magnetic gear pump with clear acrylic plastic parts to visualize the fluid-flow when operated under cavitation conditions. Surprisingly, it was discovered that a significant number of bubbles flow into the magnet-coupling section via the flow passage in the partition between the magnet-coupling section and the gear-assembly section. In particular, some of the bubbles flow into the magnet-cup cavity where they can subsequently implode. The expectation had been that a substantial majority of the cavitation bubbles would implode when the fluid exits the gears and into the high-pressure area; thus, never reaching the magnet-cup cavity. Bubble implosion within the interior of a magnet cup is especially problematic due to the relatively thin width (e.g., about 0.1 to about 0.7 mm) of the magnet-cup wall. It will be appreciated that the width of the magnet-cup wall is limited by the width of the air gap between the driving and driven magnets and associated tolerances.

The device and method embodiments disclosed herein substantially reduce the amount of bubbles flowing into a drive section of a pump, particularly the magnet-coupling section of a magnetic gear pump. In addition, these embodiments substantially interfere with the noise-energy conduction path in the fluid medium passing into the drive section of a pump. Both of these features contribute to an overall dampening of the noise generated and transmitted by a gear pump.

According to a first disclosed embodiment, there is provided a gear pump having a first section that includes a gear assembly, a second section that includes a drive assembly, and at least one passage fluidly connecting the first section and the second section, wherein the passage includes substantially non-movable walls defining a non-linear fluid-flow path. According to one variant there is provided a unitary member that includes the connecting passage defining the non-linear fluid-flow path. The gear assembly may include at least one driving gear and at least one driven gear. The drive assembly may include pump-drive mechanisms such as a magnetic coupling or other mechanical rotary arrangements. A method for reducing noise generated by such a pump is also disclosed. This method includes providing at least one passage fluidly connecting the first section and the second section, wherein the passage defines a non-linear fluid-flow path that substantially reduces the amount of the bubbles flowing from the first section into the second section.

As mentioned above, the devices and methods disclosed herein are particularly useful for suppressing noise in magnetic gear pumps. For example, one embodiment of a magnetic gear pump encompasses a first section that includes a gear assembly, a second section that includes a magnet assembly, and at least one passage fluidly connecting the first section and the second section, wherein the passage defines a non-linear fluid-flow path. Another embodiment includes a first section having a gear assembly, a second section having a magnet assembly received in a cup cavity, and a third section located between the first section and the second section. The third section includes at least one fluid-input port, at least one fluid-output port, at least one conduit for fluidly interconnecting the first section and the second section, and a member having at least one passage in fluid connection with the third section conduit and the cup cavity.

According to a further disclosed embodiment, noise generated in a magnetic gear pump having (i) a first section that includes a gear assembly for conducting a fluid flow, wherein bubbles are formed in the fluid when the fluid flows in the first section, and (ii) a second section that includes a magnet assembly received in a cup cavity, can be suppressed by substantially reducing the number of bubbles flowing from the first section to the second section. One variant of such a noise-suppression method involves providing at least one passage fluidly connecting the first section and the second section, wherein the passage defines a non-linear fluid-flow path.

The devices and methods disclosed herein are also useful for magnetic pumps in general. In particular, there is disclosed a magnetic pump having a first section that includes at least one fluid-input port and at least one fluid-output port for directing a fluid flow such that bubbles are formed in the fluid when the fluid flows through the first section. The pump also includes a second section comprising a magnet assembly received in a cup cavity, a conduit fluidly connecting the first section and the second section, and means for reducing the amount of the bubbles flowing from the first section to the second section.

There is also provided an apparatus including a magnetic gear pump, wherein the magnetic gear pump comprises a first section comprising a gear-assembly, a second section comprising a magnet assembly received in a cup cavity, and at least one passage fluidly connecting the first section and the cup cavity, wherein the passage defines a non-linear fluid-flow path.

Although not bound by any theory, it is believed that the non-linear fluid-flow path substantially reduces the number and/or size of bubbles through a combination of characteristics. For example, the non-linear fluid-flow path provides a longer fluid-travel distance, thus giving the bubbles more time to implode before entering the drive section. The bubbles may be physically stopped (i.e., filtered) and then imploded in the non-linear fluid-flow path. The angled or curved surfaces also provide a physical barrier that interferes with the noise-energy conduction path in the fluid medium passing into the drive section of a pump.

The foregoing features and advantages will become more apparent from the following detailed description of several embodiments that proceeds with reference to the accompanying figures.

BRIEF DESCRIPTION OF THE DRAWINGS

Certain embodiments are described below with reference to the following figures:

FIGS. 3A–3E depict one embodiment of a non-linear fluid-flow element, wherein FIG. 3A is a perspective view, FIG. 3B is an elevation view of one side, FIG. is a plan view, FIG. 3D is an elevation view of a second side, and FIG. 3E is an elevation view along the longitudinal axis; and FIGS. 4A–4C depict another embodiment of a non-linear fluid-flow element, wherein FIG. 4A is a perspective view, FIG. 4B is a plan view, and FIG. 4C is an elevation view.

DETAILED DESCRIPTION OF SEVERAL EMBODIMENTS

Figure 1A:
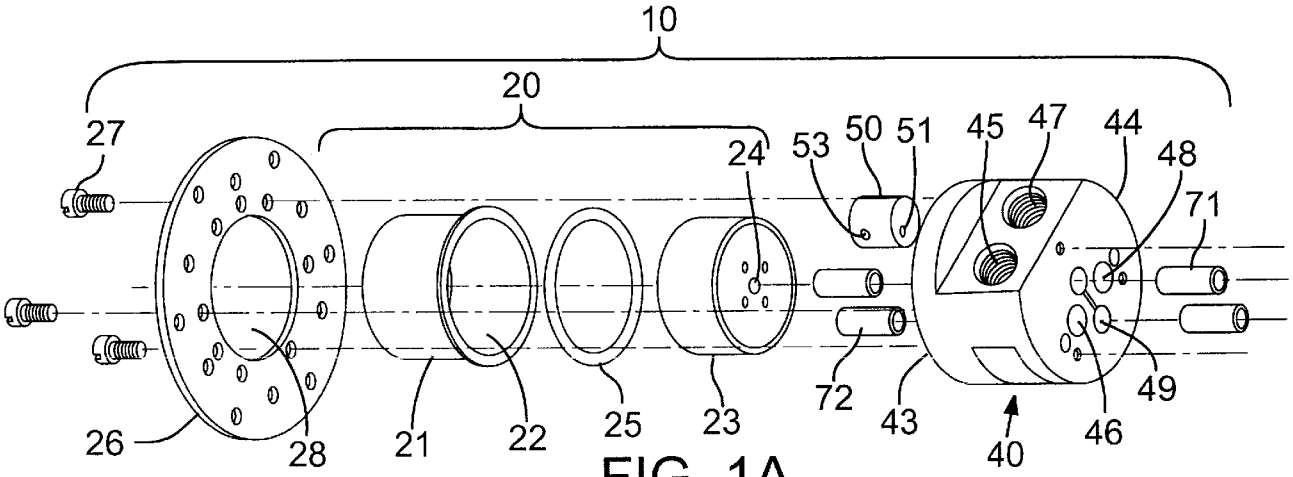
FIGS. 1A and 1B are exploded views of opposing sections, respectively, of a single magnetic pump assembly that includes a non-linear fluid-flow element according to one disclosed embodiment.

The following definitions are provided for ease of understanding and to guide those of ordinary skill in the art in the practice of the embodiments. "Gear pump" encompasses any of various pumps utilizing at least two impellers or rotors (i.e., "gears") that are contrarotated relative to each other in a casing or housing, wherein one of said gears is a "driving" gear and the remaining gear(s) in the pump are "driven" gears. Each gear has multiple teeth or lobes that are oriented radially with respect to the axis of rotation of the gear and that interdigitate (i.e., "mesh") with corresponding teeth or lobes, respectively, in the mating gear. As the gears are contrarotated, fluid enters the spaces between the teeth or lobes of each gear and is transported by the gears to a discharge port. The term "gear pump" also encompasses any of various "internal-gear" pumps as known in the art.

"Magnetic pump" encompasses magnetically driven and magnetically coupled pumps such as magnetic gear pumps, magnetic vane pumps, and similar pumps. "Linear fluid-flow path" denotes a fluid-flow path that follows the shortest distance from a point A to a point B. For example, a fluid flowing through an unobstructed straight cylindrical, tubular, or annular passage follows a linear fluid-flow path. An example of a passage defining a linear fluid-flow path is the conduit 41 depicted in FIG. 2B.

"Non-linear fluid-flow path" denotes any fluid-flow path that is not a linear fluid-flow path as described above. For example, a fluid flowing through a labyrinthine, serpentine, angled or curved passage conforms to a non-linear fluid-flow path. Another example of a non-linear fluid-flow path may be a path along a passage having walls that define at least two connected sections each having a longitudinal axis wherein the longitudinal axis of a first section is positioned at an obtuse, right, or acute angle relative to the longitudinal axis of a second section. An example of a non-linear fluid-flow path having walls defining an approximate right angle is shown in FIG. 3E as described below in more detail. A further example of a non-linear fluid-flow path is a straight passage that encompasses some type of partial obstruction around or through which the fluid flows, such as a filter or baffles.

"Unitary body or member" denotes a single part or member that is not mechanically fastened to any other part or member.

As mentioned above, certain prior-art magnetic gear pumps include a linear passage communicating between a magnet-coupling section and a gear-assembly section. For example, the pump assembly 10 depicted in FIGS. 1A and 1B includes a magnet-coupling section 20, a gear-assembly section 30, and a port section 40 between the gear-assembly section 30 and the magnet-coupling section 20. The port section 40 includes a "magnet" side 43 facing the magnet-coupling section 20 and a side 44 facing the gear-assembly section 30. A linear conduit 41 (see FIG. 2B), defined in the port section 40, provides an unobstructed linear path for fluid to flow from the gear-assembly section 30 to the magnet-coupling section 20 according to known designs.

However, the pump assembly in FIG. 1A includes an improvement over conventional designs. In particular, a non-linear flow element 50 is positioned within or contiguous with a fluid-exit orifice 42 of the linear conduit 41 (see FIGS. 2A and 2B). As described above, the addition of the non-linear flow element 50 significantly reduces the noise emanating from the pump assembly.

The embodiment of the non-linear flow element 50 in FIG. 1A is depicted in more detail in FIGS. 3A–3E. The non-linear flow element 50 includes an inlet orifice 51, an outlet orifice 52 and two side orifices 53. Defined within the non-linear flow element 50 is an angled passage 54 that includes at least two right angles as shown in FIG. 3E. In particular, angled passage 54 includes a first section 80 having a longitudinal axis 82 and a second section 81 having a longitudinal axis 83. The intersection of longitudinal axis 82 and longitudinal axis 83 defines an approximate right angle 84. As indicated by fluid-flow ("FF") arrows in FIG. 3E, during operation of the pump fluid flows through the linear conduit 41 and then enters the inlet orifice 51. The fluid then flows through the angled passage 54 and exits via the outlet orifice 52. In certain embodiments where the non-linear flow element 50 is not entirely received in the conduit 41 or there is sufficient tolerance between the outer surface of the non-linear flow element 50 body and the inner surface of the conduit 41 (described in more detail below), the fluid may also exit via one or both of the side orifices 53.

Figure 4A:
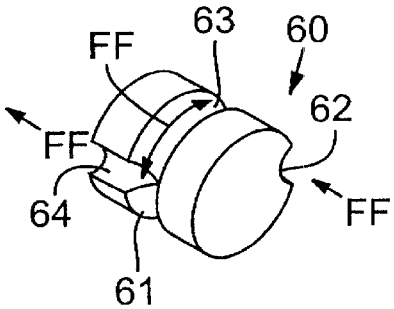
Figure 4B:
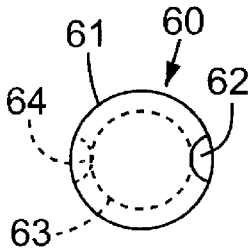
Figure 4C:
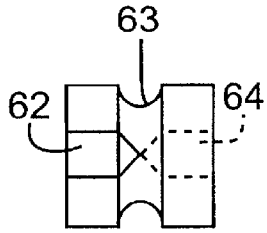

Another example of a non-linear flow element 60 is shown in FIGS. 4A–4C. The non-linear flow element 60 defines a channel 61 that includes an inlet portion 62, a circumferential portion 63, and an outlet portion 64. During pump operation, fluid flowing from the linear conduit 41 (FIG. 2B) enters the inlet portion 62 as indicated by fluid-flow ("FF") arrows in FIG. 4A. The fluid then can flow in either or both radial directions around the circumferential portion 63 and exit via the outlet portion 64. The channel 61 can have a concave profile as shown, V-shaped profile or any other profile that assists in channeling the fluid.

The fluid exiting from the outlet orifice 52 or the outlet portion 64 enters into the interior of the magnet-coupling section. Typically, the interior is a cavity 22 defined by a magnet cup 21 as described below in more detail. Since the bubbles have been substantially removed from the fluid stream entering the magnet-cup cavity 22, the frequency of bubble implosion in the magnet-cup cavity 22 is greatly reduced. Consequently, the amount of noise generated with the magnet-cup cavity 22 and transmitted through the thin magnet-cup walls is greatly reduced.

The non-linear flow elements shown in FIGS. 3A–3E and FIGS. 4A–4C and similar elements may be made from any non-corrosive material such as plastic, metal, ceramic, or composite. According to particular embodiments, these non-linear flow elements may be dimensioned so that they are received within at least a portion of the linear conduit 41. In such embodiments the non-linear flow element acts as a partial "plug" in the sense that the element partially restricts the flow of the fluid within and exiting the linear conduit 41. According to one embodiment, the complete body of the non-linear flow element is received within the linear conduit 41 so that the fluid-exit end of the non-linear flow element is substantially flush with a plane formed by the magnet side 43 of the port section 40. The non-linear flow element may extend partially or completely along the length of the linear conduit 41. Of course, if the non-linear flow element extends along the full length of the conduit 41, then no linear flow path is in communication with the non-linear fluid-flow path.

The inlet of the non-linear flow element (such as inlet orifice 51 or inlet portion 62) may have any diameter or width, but typically is not larger than the diameter or width of the linear conduit 41. In particular embodiments the diameter or width of the inlet may be significantly smaller than the diameter or width of the conduit 41. For example, the diameter or width of the inlet may range from about 0.1 to about 0.3 mm and the diameter or width of the conduit 41 may range from about 0.3 to about 13.0 mm. The longitudinal axis of the inlet of the non-linear flow element may be aligned with or offset from the longitudinal axis of the linear conduit 41.

The non-linear flow element simply can be inserted into the linear conduit 41 and held in place by friction. Alternatively, the non-linear flow element can include a flange at its outlet end to further secure the non-linear flow element.

Figure 3A:
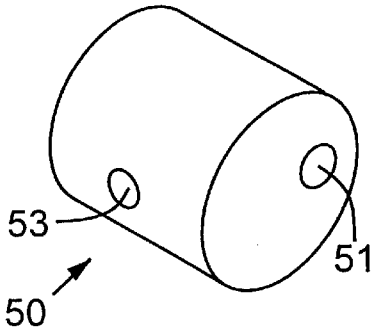
Figure 3B:
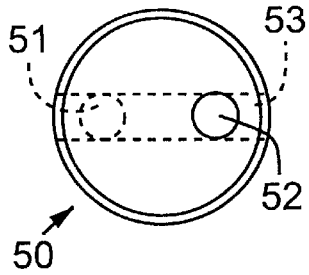

An advantage of the non-linear flow elements illustrated, for example, in FIGS. 3A and 4A is that they can be unitary (i.e., single) bodies that are relatively simple to machine and to include in a conventional pump configuration. It will be appreciated that numerous variations of non-linear fluid-flow paths are possible. For example, a non-linear flow element can be formed to include at least one passage having walls that define any shape of angular or curved pathways.

There may be numerous other designs or methods for providing the non-linear fluid-flow path. For example, the partition separating the gear section from the drive section may be machined to define a non-linear passage. Thus, the non-linear fluid-flow path is integrally included in the partition. According to a particular embodiment, a port section or similar partition of a magnetic pump could define a non-linear fluid conduit communicating between the magnet-coupling section and the gear-assembly section. In this embodiment, the fluid conduit may not even include a linear section (i.e., the length of the fluid conduit defines a non-linear fluid-flow path).

Another example of providing a non-linear fluid-flow path is placing filtration material, baffles, or similar types of partial obstructions into the flow path between the gear-assembly section and the drive-assembly section. The dimensions of the filtration material could be selected to capture the bubbles in the fluid stream.

Combinations of the different variants for providing a non-linear fluid-flow path could be utilized. For example, a filtration material could be inserted into the linear conduit 41 in addition to including a non-linear flow element such as element 50 or 60.

A further advantage of the non-linear fluid-flow configurations and methods disclosed herein is that they do not require any moving parts such as those found in a valve (although moving parts optionally could be included). Put another way, the walls of the passage defining the non-linear fluid-flow path are substantially non-movable. A lack of moving parts simplifies manufacturing and potentially increases the life of the pump.

Referring further to FIG. 1A, the port section 40 also includes an inlet port 45 that communicates with an inlet opening 46 for allowing fluid to enter the interior of the gear-assembly section 30. The port section 40 further includes an outlet port 47 that communicates with an outlet opening 48 for allowing fluid to exit the gear-assembly section 30. The inlet and outlet ports 45, 47, respectively, can be threaded or otherwise made capable of accommodating any of various suitable hydraulic fittings as required. The particular location of the inlet port and outlet port may vary, and their orientation relative to the gear-assembly section and the magnet-coupling section may be altered as desired to provide a different fluid flow or to accommodate additional parts or alternative configurations of components.

Figure 2A:
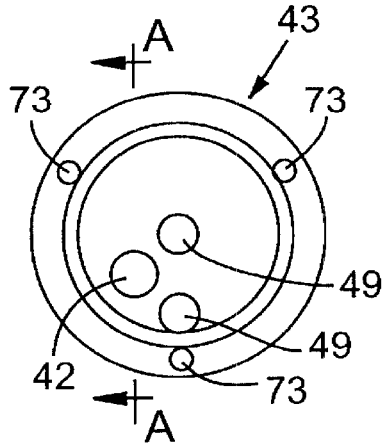
FIG. 2A is an elevation view of a magnet side of a port section of the magnetic pump assembly shown in FIG. 1A.
Figure 2B:
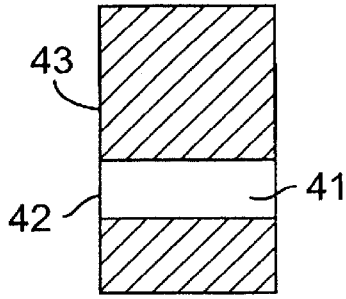
FIG. 2B is a partial sectional view along the plane A defined in FIG. 2A.

An inlet orifice (not shown) for the linear conduit 41 opens into the fluid discharge passage defined by the outlet port 47 and the outlet opening 48. FIG. 2A shows the fluid-exit orifice 42 that communicates with the inlet orifice.

The gear-assembly section 30 includes a gear-assembly housing 31 that jackets a cavity plate 32 and a static fluid seal such as two elastomeric gasket seals 33. The elastomeric gasket seals 33 may be compressed between the cavity plate 32 and the gear-assembly housing 31. An O-ring that is received within the cavity plate 32 could be substituted for the gasket seals 33. Received within the cavity plate 32, is a driving gear 34 coaxially affixed to an elongate drive shaft 35, and a driven gear 36 adapted to mesh with the driving gear 34. The driven gear 36 is coaxially affixed to an elongate driven shaft 37 to permit rotation of the driven gear 36 about its axis. The cavity plate 32 includes a pair of concave surfaces 39 and defines a gear cavity 38 conforming to the profile and thickness of the meshed driving gear 34 and driven gear 36. The gear cavity 38 is shaped so as to allow the driving gear 34 and driven gear 36 to rotate freely about their respective axes in the gear cavity 38 with minimal clearance between the gears 34, 36 and the walls of the gear cavity 38. As can be readily appreciated, the gears 34, 36 rotate counter-currently relative to each other (i.e., they "contrarotate"). The gear-assembly housing 31 also extends laterally to allow the inlet opening 46 and the outlet opening 48 to open into the interior of the gear-assembly housing 31 and the gear cavity 38. It should be recognized that the gear configuration may vary and could include, for example, more than two gears.

The elongate drive shaft 35 is suspended between a magnet assembly 23 and the cavity plate 32. The elongate driven shaft 37 is suspended between the port section 40 and the cavity plate 32. The port section 40 defines a pair of bores 49 for receiving the shafts 35, 37, respectively. The magnet assembly 23 defines one bore 24 for receiving the drive shaft 35. Bushings or bearings may be used to rotationally support the shafts 35, 37. For example, front bushings 70 may be received in the gear-assembly housing 31, middle bushings 71 may be received in the gear side of the bores 49 of the port section 40, and rear bushings 72 may be received in the magnet side 43 of the bores 49.

One end of the drive shaft 35 includes an interlocking mechanism (not shown) such as a splined end, square end, slot or other suitable interlock. This end of the drive shaft 35 is received in the bore 24 of the magnet assembly 23 so that the drive shaft 35 rotates in conjunction with the movement of the magnet assembly 23.

The magnet assembly 23 includes a permanent driven magnet (not shown) as known in the art. The magnet assembly 23 is received within the cavity 22 defined by the magnet cup 21 so that the magnet assembly 23 is free to rotate in correspondence with the drive magnet (not shown). An O-ring 25 is located at the rim of the magnet cup 21.

The magnetic pump is preferably driven by an electric motor (not shown) magnetically coupled in a conventional manner to the magnet assembly 23. For example, FIG. 1A shows a mounting plate 26 for mounting the pump assembly 10 to an electric motor. The mounting plate 26 is secured to the port section 40 via suitable fasteners such as screws 27 received within orifices 73 defined in the magnet side 43 of the port section 40. The mounting plate 26 defines an annular void 28 for receiving the magnet cup 21. An annular driving magnet (not shown) can be mounted to an armature of the electric motor, wherein the driving magnet is positioned coaxially and circumferentially around the magnet cup 21 so as to magnetically engage the magnet assembly 23 inside the magnet cup 21. It is also possible to drive the magnet assembly 23 using an "integrated motor" configuration with a stator coil rather than a permanent magnet as disclosed, for example, in U.S. Pat. Nos. 5,096,390 and 5,197,865.

Notwithstanding the foregoing, it will be understood that other types of prime movers (i.e., motors and the like) and other types of couplings (including direct couplings) between the prime mover and the pump assembly 10 can be employed. Alternative prime movers include, but are not limited to, hydraulic motors, mechanically actuated drive means, internal combustion engines, and any of various other prime movers capable of directly or indirectly imparting rotary motion to the driving gears. The magnetic coupling means described above can be replaced with any of various direct drives, pulley drives, gear drives, and analogous means according to the intended use and mechanical environment of the pump assembly 10 and generally understood principles of machine design. As is generally understood, using a magnetic coupling eliminates a need for passing a drive shaft from the external environment to inside the pump assembly 10, which would require a rotary seal.

Figure 1B:
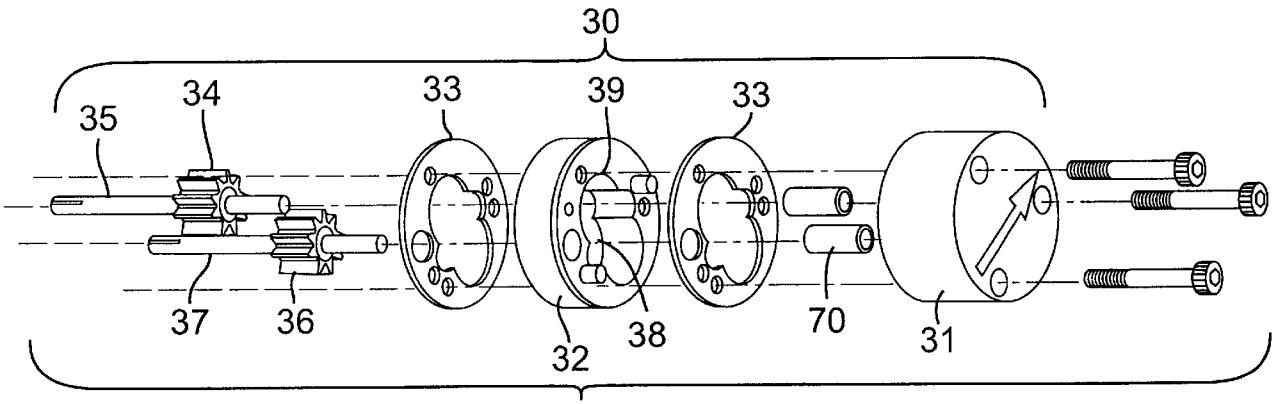

During operation of the pump assembly 10 shown in FIGS. 1A and 1B, the contrarotation of the gears 34 and 36 moves fluid through the pump assembly 10. In particular, fluid enters the inlet port 45, flows through the port section 40 and subsequently enters the gear-assembly section 30 via inlet opening 46. In the gear-assembly section the fluid is carried by the arms of gears 34 and 36 around the outside circumference of gears 34 and 36 then exits via the outlet opening 48 into the port section 40. The fluid flows from the outlet opening 48 through the port section 40 and is discharged from the pump assembly 10 via the outlet port 47.

A portion of the fluid in the discharge stream is diverted from the gear-assembly section 30 to the magnet-coupling section 20 by flowing through the linear conduit 41 and the non-linear flow element 50 as described above. The fluid in the magnet-coupling section 20 flows back into the port section 40 through the tolerance between the shafts 35, 37 and their corresponding respective bushings 71, 72. Such fluid passage through the magnet-coupling section 20 offers several benefits. The continuous fluid flow prevents stagnant areas from developing on surfaces in the magnet-coupling section 20. In addition, the fluid flow between the shafts and the bushings purges debris and other possible wear products away from the shafts and their bushings, provides for effective heat dissipation from the shafts and their bushing, and maintains a lubricant in the space between the shaft surface and the bushing surface.

The pump configurations disclosed herein can be used in a variety of fluid systems apparatus such as delivery of liquids in medical instrumentation, delivery of liquid ink to continuous ink-jet printer heads and water purification. The disclosed pumps are especially useful in environments that require minimal noise. The pumps may be incorporated into such apparatus by techniques and designs well known in the art.

Having illustrated and described the several embodiments, it should be apparent to those of ordinary skill in the art that the invention comprehends all alternatives, modifications, and equivalents as may be included within the spirit and scope of the invention.

What is claimed is:

1. A gear pump, comprising:

a first section comprising a gear assembly;

a second section comprising a drive assembly; and at least one connecting passage fluidly connecting the first section and the second section together, wherein the connecting passage includes substantially non-movable walls defining a non-linear fluid-flow path.

2. A gear pump according to claim 1, further comprising a partition situated between the first section and the second section, the partition defining the connecting passage.

3. A gear pump according to claim 1, wherein the non-linear fluid-flow path conforms to at least one shape selected from labyrinthine, serpentine, angled, and curved.

4. A gear pump according to claim 1, wherein the connecting passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

5. A gear pump, comprising:

a first section comprising a gear assembly;

a second section comprising a drive assembly; and a unitary member defining at least one connecting passage fluidly connecting the first section and the second section together, wherein the passage defines a non-linear fluid-flow path.

6. A gear pump according to claim 5, wherein the non-linear fluid-flow path conforms to at least one shape selected from labyrinthine, serpentine, angled, and curved.

7. A gear pump according to claim 5, wherein the connecting passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

8. A gear pump according to claim 5, wherein the unitary member is cylindrical and includes at least one inlet orifice defined in a first surface and at least one outlet orifice defined in a second surface, the inlet orifice and the outlet orifice being in fluid communication with each other via the connecting passage.

9. A magnetic gear pump, comprising:

a first section comprising a gear assembly;

a second section comprising a magnet assembly; and at least one connecting passage fluidly connecting the first section and the second section with each other, wherein the passage defines a non-linear fluid-flow path.

10. A magnetic gear pump according to claim 9, wherein the non-linear fluid-flow path conforms to at least one shape selected from labyrinthine, serpentine, angled, and curved.

11. A magnetic gear pump according to claim 9, wherein the connecting passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

12. A magnetic gear pump according to claim 9, further comprising a partition between the first section and the second section, the partition defining the connecting passage.

13. A magnetic gear pump according to claim 9, further comprising a partition between the first section and the second section, wherein the partition includes a conduit that fluidly communicates with the connecting passage.

14. A magnetic gear pump according to claim 9, further comprising a member that defines the connecting passage.

15. A magnetic gear pump according to claim 14, wherein the member is cylindrical and includes at least one inlet orifice defined in a first surface and at least one outlet orifice defined in a second surface, the inlet orifice and the outlet orifice being in fluid communication with each other via the connecting passage.

16. A magnetic gear pump according to claim 15, further comprising a partition between the first section and the second section, wherein the partition includes a conduit that fluidly communicates with the inlet orifice of the connecting passage.

17. A magnetic gear pump according to claim 16, wherein the member is at least partially received within the conduit.

18. A magnetic gear pump according to claim 17, wherein the non-linear fluid-flow path conforms to at least one shape selected from labyrinthine, serpentine, angled and curved.

19. A magnetic gear pump according to claim 17, wherein the connecting passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

20. A magnetic gear pump according to claim 9, wherein the magnet assembly is received within a cup cavity, and the connecting passage fluidly connects the first section and the cup cavity with each other.

21. A magnetic pump, comprising:

a first section comprising at least one fluid-input port and at least one fluid-output port for directing a fluid flow such that bubbles are formed in the fluid whenever the fluid flows through the first section;

a second section comprising a magnet assembly received in a cup cavity;

a conduit fluidly connecting the first section and the second section; and bubble-reducing means for reducing the amount of the bubbles flowing from the first section to the second section.

22. A magnetic pump according to claim 21, wherein the bubble-reducing means comprises a non-linear fluid-flow passage at least partially received or located within the conduit.

23. A magnetic pump according to claim 21, further comprising a partition member that includes the fluid-inlet port, the fluid-outlet port, and the conduit, wherein the bubble-reducing means comprises a passage defined by the conduit such that the passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

24. A magnetic pump according to claim 21, further comprising a partition member that includes the fluid-inlet port, the fluid-outlet port, and the conduit, wherein the bubble-reducing means comprises a member having a passage in fluid communication with the conduit, and the member passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

25. A magnetic pump according to claim 21, wherein the bubble-reducing means comprises a filtration material.

26. A magnetic gear pump, comprising:

a first section comprising a gear assembly;

a second section comprising a magnet assembly received in a cup cavity;

a third section located between the first section and the second section, wherein the third section includes at least one fluid-input port, at least one fluid-output port, and at least one conduit for fluidly interconnecting the first section and the second section; and a member having at least one passage in fluid connection with the third section conduit and the cup cavity.

27. A magnetic gear pump according to claim 26, wherein the passage defines a non-linear fluid-flow path.

28. A magnetic gear pump according to claim 27, wherein the non-linear fluid-flow path conforms to at least one shape selected from labyrinthine, serpentine, angled, and curved.

29. A magnetic gear pump according to claim 27, wherein the passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

30. A magnetic gear pump according to claim 27, wherein the member is at least partially received within the conduit of the third section.

31. A method for reducing noise generated in a gear pump that includes (i) a first section comprising a gear assembly for conducting a flow of fluid in which bubbles are formed as the fluid flows through the first section and (ii) a second section comprising a drive assembly, the method comprising:

providing at least one connecting passage fluidly connecting the first section and the second section with each other, wherein the passage defines a non-linear fluid-flow path that substantially reduces the amount of the bubbles flowing from the first section into the second section.

32. A method according to claim 31, wherein the non-linear fluid-flow path conforms to at least one shape selected from labyrinthine, serpentine, angled, and curved.

33. A method according to claim 31, wherein the connecting passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

34. A method for reducing noise generated in a magnetic gear pump that includes (i) a first section comprising a gear assembly for conducting a fluid flow in which bubbles are formed as the fluid flows in the first section and (ii) a second section comprising a magnet assembly received in a cup cavity, the method comprising:

providing at least one passage fluidly connecting the first section and the cup cavity with each other, wherein the passage defines a non-linear fluid-flow path.

35. A method according to claim 34, wherein the non-linear fluid-flow path conforms to at least one shape selected from labyrinthine, serpentine, angled, and curved.

36. A method according to claim 34, wherein the connecting passage is defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

37. A method for reducing noise generated in a magnetic gear pump that includes (i) a first section comprising a gear assembly for conducting a fluid flow in which bubbles are formed as the fluid flows in the first section and (ii) a second section comprising a magnet assembly received in a cup cavity, the method comprising:

substantially reducing the number of bubbles flowing from the first section to the second section.

38. A method according to claim 37, further comprising:

providing a non-linear fluid flow path between the first section and the second section; and flowing the fluid from the first section through the non-linear fluid flow path to the second section.

39. A method according to claim 37, further comprising:

providing a filtration material between the first section and the second section; and flowing the fluid from the first section through the filtration material to the second section.

40. A method for reducing noise generated in a magnetic gear pump that includes (i) a first section comprising a gear assembly, (ii) a second section comprising a magnet assembly situated in a cup cavity, and (iii) a third section located between the first section and the second section wherein the third section includes at least one fluid input port, at least one fluid output port, and at least one conduit for fluidly interconnecting the first section and the second section, the method comprising:

providing a member between the second section and the third section that substantially reduces the amount of bubbles flowing into the cup cavity.

41. A method according to claim 40, wherein the member is at least partially inserted into the conduit.

42. A method according to claim 40, wherein the member includes a passage defining a non-linear fluid-flow path.

43. A method according to claim 40, wherein the member includes a passage defining a serpentine, angular, or circular flow path for the fluid flowing from the third section into the cup cavity through the passage.

44. A method according to claim 40, wherein the member includes a passage defining a flow path for the fluid flowing from the third section into the cup cavity, the passage being defined by walls that define a first section and a second section, the first section having a first longitudinal axis and the second section having a second longitudinal axis, wherein the first section and the second section are situated contiguously with each other so that the first longitudinal axis is positioned at an obtuse, right, or acute angle relative to the second longitudinal axis.

45. An apparatus comprising a magnetic gear pump, the magnetic gear pump comprising:

a first section comprising a gear assembly;

a second section comprising a magnet assembly received in a cup cavity; and at least one passage fluidly connecting the first section and the cup cavity with each other, wherein the passage defines a non-linear fluid-flow path for fluid flowing through the passage from the first section to the cup cavity.

* * * * *

UNITED STATES PATENT AND TRADEMARK OFFICE

CERTIFICATE OF CORRECTION

PATENT NO. : 6,551,070 B2
DATED : April 22, 2003
INVENTOR(S) : Burns et al.

Figure 3C:
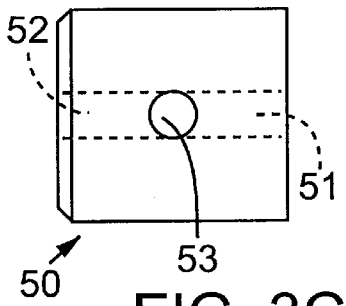
Figure 3D:
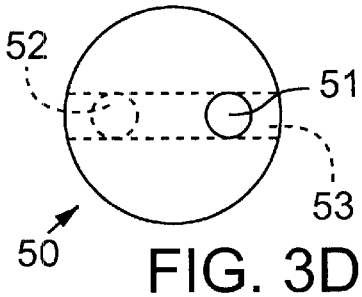
Figure 3E:
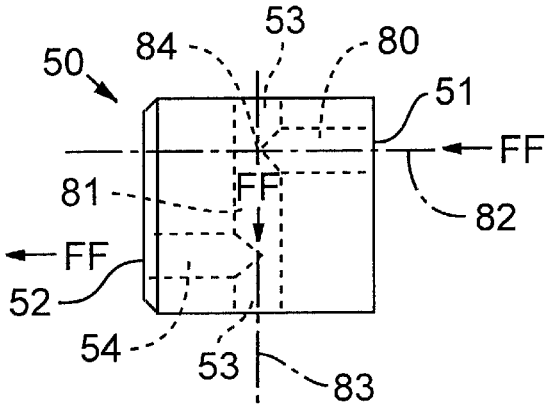

It is certified that error appears in the above-identified patent and that said Letters Patent is hereby corrected as shown below:

Column 3,
Line 56, "FIG. is a plan view," should be -- FIG. 3C is a plan view --.

Signed and Sealed this

Nineteenth Day of April, 2005

JON W. DUDAS
*Director of the United States Patent and Trademark Office*